US007192191B2

(12) United States Patent
Wedi et al.

(10) Patent No.: US 7,192,191 B2
(45) Date of Patent: Mar. 20, 2007

(54) RECLOSABLE PACKAGING CONTAINER

(75) Inventors: Johannes Wedi, Emsdetten (DE); Markus Kujat, Osnabruck (DE)

(73) Assignee: Bishof + Klein GmbH & Co. KG, Lengerich (DE)

( * ) Notice: Subject to any disclaimer, the term of this patent is extended or adjusted under 35 U.S.C. 154(b) by 321 days.

(21) Appl. No.: 10/249,810

(22) Filed: May 9, 2003

(65) Prior Publication Data

US 2003/0210837 A1 Nov. 13, 2003

(51) Int. Cl.
*B65D 33/16* (2006.01)
*B65D 30/20* (2006.01)

(52) U.S. Cl. ..... 383/64; 383/120

(58) Field of Classification Search ..... 383/120, 383/63, 203, 210, 5, 61.1, 61.2, 64
See application file for complete search history.

(56) References Cited

U.S. PATENT DOCUMENTS

| | | | | | |
|---|---|---|---|---|---|
| 3,633,642 | A * | 1/1972 | Siegel | 383/64 |
| 5,364,189 | A * | 11/1994 | Kuge et al. | 383/61.2 |
| 5,442,838 | A | 8/1995 | Richardson et al. | |
| 5,775,812 | A | 7/1998 | St. Phillips et al. | |
| 5,788,378 | A * | 8/1998 | Thomas | 383/63 |
| 5,938,339 | A * | 8/1999 | Ouchi | 383/63 |
| 6,030,123 | A * | 2/2000 | Mitarai | 383/63 |
| 6,071,011 | A | 6/2000 | Thomas et al. | |
| 6,186,663 | B1 * | 2/2001 | Ausnit | 383/63 |
| 6,261,000 | B1 * | 7/2001 | Bois | 383/120 |
| 6,325,543 | B1 * | 12/2001 | Ausnit | 383/210.1 |
| 6,361,213 | B2 | 3/2002 | Randall | |
| 6,461,043 | B1 * | 10/2002 | Healy et al. | 383/204 |
| 2001/0014186 | A1 | 8/2001 | Randall | |

FOREIGN PATENT DOCUMENTS

| | | | | |
|---|---|---|---|---|
| EP | 0 834 454 | | 4/1998 | |
| JP | 405097151 | * | 4/1993 | 383/61.1 |

* cited by examiner

*Primary Examiner*—Jes F. Pascua
(74) *Attorney, Agent, or Firm*—Gundrun E. Huckett

(57) ABSTRACT

A gusseted reclosable packaging container has a plastic closure device arranged at the upper container edge and extending across the container width. The closure device has closure parts each having a profiled strip with a connecting flap connected to the front wall and the back wall, respectively, by a connecting seam. One profiled strip has a groove-shaped receiving section and the other a tongue-shaped engagement section. The closure device has a slide engaging across the profiled strips such that, when the slide moves along the profiled strips, it pushes the profiled strips together or moves them apart for closing or opening the closure device. The container gussets have upper ends ending below the upper edge and above a lower edge of the connecting flaps or are provided with a cutout. The gussets are closed at the upper ends or at the cutouts by one of the connecting seams.

7 Claims, 3 Drawing Sheets

RECLOSABLE PACKAGING CONTAINER

BACKGROUND OF INVENTION

The invention relates to a reclosable packaging container in the form of a bag or sack of plastic foil or a composite foil with inner plastic layer, comprising a closure device of plastic material arranged at the upper edge of the container and extending across the entire inner width of the container, which comprises a first closure part connected to the front wall of the container and a second closure part connected to the back wall of the container, wherein one closure part comprises a profiled strip with a groove-like profiled receiving section and the other closure part comprises a profiled strip with a tongue-like profiled engagement section and wherein both closure parts are provided with a connecting flap formed as a unitary part of the profiled strip, which is connected with the front wall or the back wall of the container by a connecting seam, respectively, and wherein a slide is provided which engages across the profiled strips like a rider and, when moved, pushes the profiled strips together for closing or moves them apart for opening.

Known packaging containers of the aforementioned kind are known in different configurations (U.S. Pat. Nos. 5,442,838, 6,361,213, U.S. Pat. No. -2001-014,186-A1, EP 1053948 A2, U.S. Pat. No. 5,775,812 A). These configurations have in common that the packaging container is formed as a flat bag or a flat sack and the connecting flaps of the closure parts of the closure device are connected independent from one another to the front wall and the back wall of the bag or the sack so that, as needed, an additional closure is to be provided which enables a first access to the contained material only upon opening it.

SUMMARY OF INVENTION

The invention deals with the problem of providing a packaging container with greater filling capacity which, while being very simple, provides safe closure by means of a reclosable closure device.

The invention solves the problem by a packaging container having the following features: the container is embodied as a gusseted bag or a gusseted sack, wherein the gussets end in an area below the upper edge of the container and at the same time above the lower edge of one of the connecting flaps of the closure device or, in a modified embodiment, are provided with a cutout. At their upper ends or in the area of their cutouts, they are closed by the connecting seam between the neighboring connecting flap and the neighboring container wall.

The packaging container according to the invention, with respect to an identical contour size, has a significantly greater filling capacity and, when provided with a suitable bottom configuration, is able to stand on its own. At the same time, the closure device ensures that the gussets are also integrated into the safe closure of the interior of the container. The preferred mutual connection of the connecting flaps of the closure parts of the closure device at their lower edges provides a first closure which can be opened only by separating the connection of the connecting flaps at their lower edges so that by means of one and the same closure device a principally desirable double closure can be realized in a particularly simple way.

Important additional features will be explained in the following.

DETAILED DESCRIPTION

Figure 1:
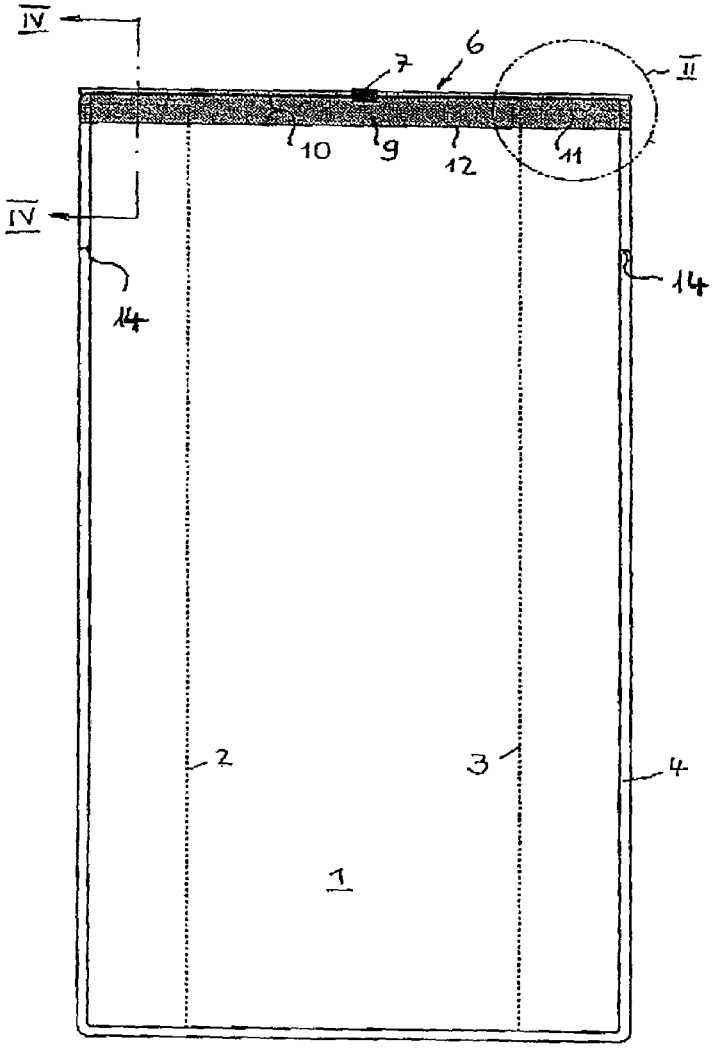
FIG. 1 shows a reclosable packaging container according to the invention in a front view.

The packaging container illustrated in the drawing has the shape of a gusseted container (gusseted bag or gusseted sack) and is comprised of a plastic film or a film composite in which the composite film is provided with a plastic layer A on the side facing the interior of the packaging container and an external layer B.

The packaging container comprises in detail a front wall 1, facing the viewer in FIG. 1; a back wall 1*a* of a congruent configuration, facing away from the viewer; two narrow sidewalls formed by gussets 2, 3; and a bottom, not illustrated in detail in the drawing. The bottom can have any suitable configuration and, when embodied as a shaped bottom, has a width which corresponds to the width of the narrow sidewalls. In the filled state, the packaging container can therefore have a parallelepipedal basic shape which in cross-section, depending on the dimensions of the gussets 2, 3, is rectangular or square.

The front wall 1 is connected by a closure seam 4, which is U-shaped in the front view according to FIG. 1, to the edges of the adjoining gusset parts 2, 3 and the bottom part. The closure seam 4 extends to the upper edge 5 of the container. A matching connecting seam, which is configured like all connecting seams of the packaging container according to the invention, as a welded or fused seam, connects also the back wall 1*a*, facing away from the viewer in FIG. 1, to the gusset parts 2, 3 and the bottom part.

At its upper opening edge 5, the packaging container has a closure device, which in its entirety is identified by reference numeral 6. It comprises a first closure part 8, 9 connected to the front wall 1 of the container and a second closure part 8*a*, 9*a* connected to the back wall of the container, wherein the first closure part comprises a profiled strip 8 having, for example, a groove-like profiled receiving section and the second closure part a profiled strip 8*a* comprising, for example, a tongue-like profiled engaging section. The closure parts 8, 9; 8*a*, 9*a* are provided with a connecting flap 9, 9*a* formed as a unitary part of the profile strips 8, 8*a*. The connecting flap 9 of the first closure part is connected to the front wall 1 and the connecting flap of the second closure part to the back wall 1*a* of the container. Moreover, a slide 7 is provided which engages the profile strips 8, 8*a* of both closure parts 8, 9; 8*a*, 9*a* like a rider and which, when being moved, pushes the profile strips 8, 8*a* together for closing or moves them apart for opening.

The connecting flaps 9, 9*a* of the closure parts are connected to one another at their lower edges 12 or integrally pass into one another and form in this way a first closure which is to be opened by separating the closure flaps at their lower connected edges 12, wherein an intact closure indicates the prior inaccessibility of the material contained in the packaging container.

Figure 2:
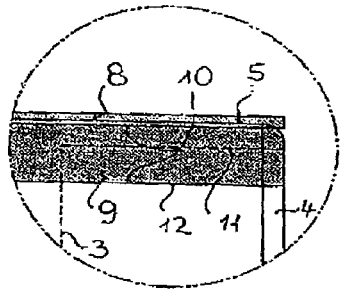
FIG. 2 shows a magnified illustration of the detail II of FIG. 1.
Figure 3:
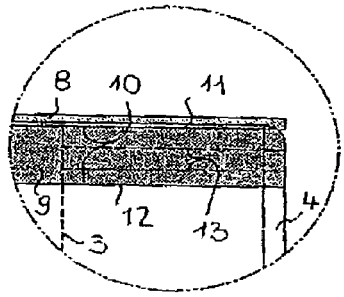
FIG. 3 is a magnified illustration similar to FIG. 2 for illustrating a modified embodiment.
Figure 4:
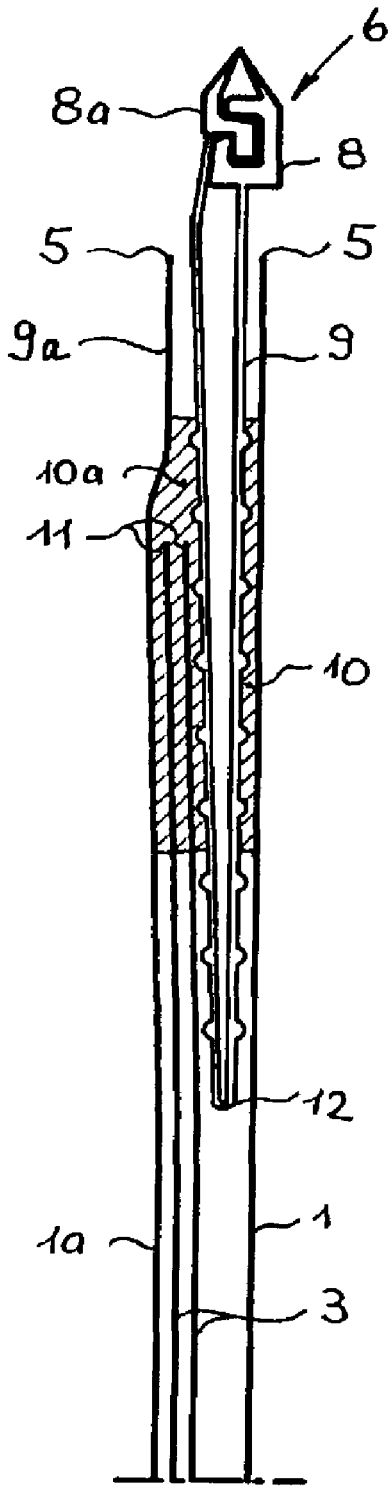
FIG. 4 shows a broken-away section along the line IV—IV of FIG. 1.
Figure 5:
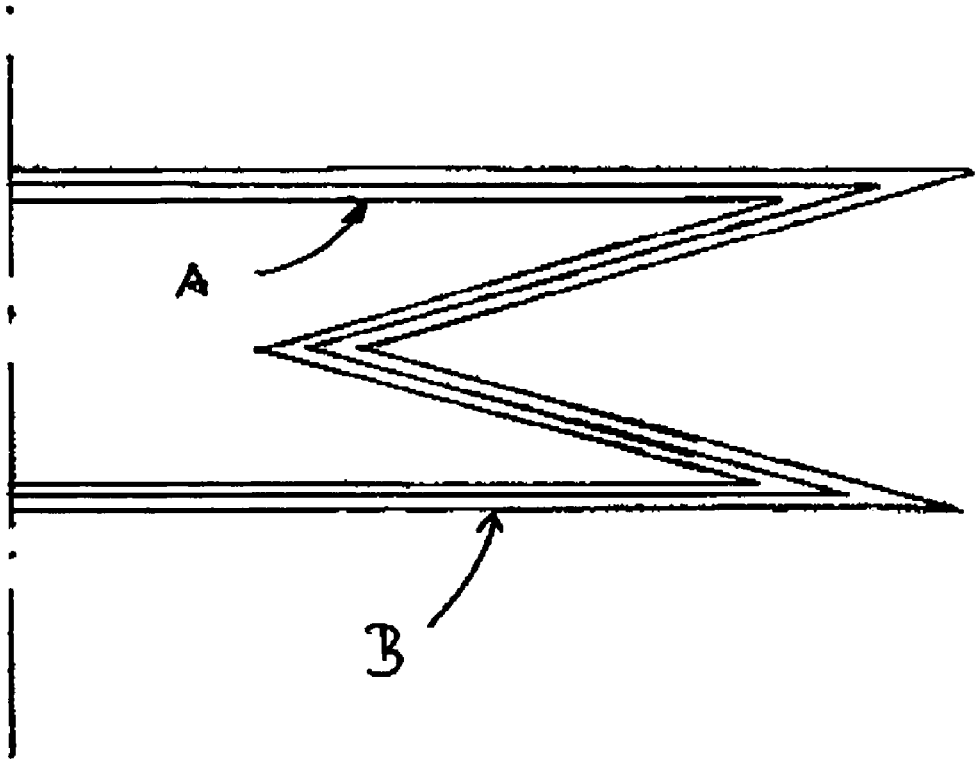
FIG. 5 shows a cross-section along the section line V—V of FIG. 1 illustrating a composite bag material.

For example, the gussets 2, 3, which are somewhat shorter relative to the total length of the packaging container, end between the connecting flap 9*a* and the back wall 1*a*, and are closed by means of the connecting seam 10 between connecting flap 9*a* and back wall 10*a*. This is illustrated in particular in FIG. 2 which shows the position of the upper edges 11 of the gusset 3 within the connecting seam 10. In one configuration of a packaging container, the upper ends 11 of the gussets 2, 3 end approximately 5–12 mm below the upper edge 5 of the container while the lower edges 12 of the connecting flaps are provided approximately 18–30 mm below the upper edge 5 of the container. The upper ends 11 of the gussets 2, 3 are positioned approximately within the upper third of the connecting seam 10, which can have a width of approximately 7–15 mm. In the modified embodiment of FIG. 3, cutouts 13 are located between the lower edges 12 of the connecting flaps 9 and the upper edge 11 of the gussets; the gussets are closed in the area of the cutouts 13 by the closing seam 10. The cutouts 13 of the gussets are positioned approximately within the connecting seam 10 having a width of approximately 7–15 mm. The cutouts 13 are formed by stamping.

When producing the packaging container, the U-shaped outer closure seam 4, which connects the front wall 1 with the gusset parts 2, 3 (and a bottom part), is first left open in an area adjoining the upper container edge 5 and extending to the boundary line 14 and, at a later time, in particular, after insertion of the closure device 6, is completed. The length of such a subsequently provided closure seam portion is approximately 40–60 mm. This makes it possible that the connecting flaps 9, 9*a* of the closure device 6 are integrated at both outer ends at the same sides in the subsequently added portions of the closure seam 4 so that a tight closure is ensured also in this respect.

Filling of the container can be realized via the bottom side. However, filling from the top is also possible when, for example, the connecting seam 10 is at least partially left open between the closure flap 9 and the front wall 1 and completed after filling.

While specific embodiments of the invention have been shown and described in detail to illustrate the inventive principles, it will be understood that the invention may be embodied otherwise without departing from such principles.

What is claimed is:

1. A bag-shaped reclosable packaging container of plastic film, the packaging container comprising:

a gusseted container having container walls and an upper edge, wherein the container walls comprise a front wall and a back wall;

a closure device of plastic material arranged at the upper edge and extending across an entire inner width of the basic container;

the closure device comprising a first closure part and a second closure part, wherein the first closure part has a first profiled strip provided with a first connecting flap formed as a unitary part of the first profiled strip and wherein the second closure part has a second profiled strip provided with a second connecting flap formed as a unitary part of the second profiled strip;

wherein the first connecting flap is connected to the front wall by a first connecting seam and the second connecting flap is connected to the back wall by a second connecting seam;

wherein one of the first and second profiled strips has a groove-shaped profiled receiving section and the other one of the first and second profiled strips has a tongue-shaped profiled engagement section;

wherein the closure device comprises a slide engaging across the first and second profiled strips, wherein the slide, when moved along the first and second profiled strips, pushes the profiled strips together for closing the closure device or moves them apart for opening the closure device;

wherein the gusseted container has gussets connecting the front wall and the back wall, respectively;

wherein the gussets have a cutout below the first and second profiled strips and above the lower edge of one of the first and second connecting flaps and the gussets are sealed in the area of the cutouts by one of the first and second connecting seams between the first connecting flap and the front wall or the second connecting flap and the back wall;

wherein the gussets are subsequently connected by a closure seam portion to at least one of the front wall and the back wall in an area adjoining the upper edge which area, prior to insertion and fixation of the closure device, was not connected to allow insertion of the closure device, wherein the first and second connecting flaps have outer ends proximal to the gussets, wherein the outer ends are integrated into the closure seam portion connecting the front wall and the gussets or the back wall and the gussets.

2. The packaging container according to claim 1, wherein the plastic film is a composite film with an inner plastic layer.

3. The packaging container according to claim 1, wherein the closure seam portions in an upper area of the gusseted container connecting the gussets to the front wall and the back wall have a length of approximately 40–60 mm.

4. The packaging container according to claim 1, wherein the lower edges of the first and second connecting flaps are connected with one another and form a first closure indicating prior inaccessibility of material packaged in the packaging container, wherein the first closure is to be opened for accessing the material packaged in the packaging container by separating the connection of the lower edges.

5. The packaging container according to claim 1, wherein the lower edges of the first and second connecting flaps are positioned approximately 18–30 mm below the upper edge of the gusseted container.

6. The packaging container according to claim 1, wherein the cutouts of the gussets are positioned approximately within one of the first and second connecting seam having a width of approximately 7–15 mm.

7. The packaging container according to claim 1, wherein the cutout of the gussets is formed by stamping.

* * * * *